United States Patent [19]

Schrödter et al.

[11] Patent Number: 4,988,387

[45] Date of Patent: Jan. 29, 1991

[54] AGENT AND PROCESS FOR DESULFURIZING MOLTEN METALS

[75] Inventors: Hermann Schrödter, Erftstadt; Albert Braun, Hürth, both of Fed. Rep. of Germany

[73] Assignee: Hoechst Aktiengesellschaft, Frankfurt am Main, Fed. Rep. of Germany

[21] Appl. No.: 485,960

[22] Filed: Feb. 27, 1990

[30] Foreign Application Priority Data

Mar. 13, 1989 [DE] Fed. Rep. of Germany ..... 3908071

[51] Int. Cl.[5] ..... C21C 7/02

[52] U.S. Cl. ..... 75/312

[58] Field of Search ..... 75/312

[56] References Cited

U.S. PATENT DOCUMENTS 3,771,259 11/1973 Portz et al. ..... 75/312
3,885,956 5/1975 Obst ..... 75/312
4,323,392 4/1982 Braun et al. ..... 75/312
4,358,312 11/1982 Braun ..... 75/312
4,395,282 7/1983 Braun ..... 75/312
4,764,211 8/1988 Meichsner et al. ..... 75/312

*Primary Examiner*—Peter D. Rosenberg
*Attorney, Agent, or Firm*—Connolly and Hutz

[57] ABSTRACT

An agent for desulfurizing molten metals, in particular molten iron, comprises a $CaC_2/CaO$ crystal blend with a maximum of 62% by weight of $CaC_2$, gas-evolving substances and 0 to 44% by weight of metallic magnesium as the components.

For desulfurizing molten metals, in particular molten iron, using this agent, either the mixture comprising both the $CaC_2/CaO$ crystal blend and gas-evolving substances, and the magnesium, are fluidized separately and the two fluidized products are combined immediately before they enter the melt, or the $CaC_2/CaO$ crystal blend, gas-evolving substances and magnesium components are fluidized together and the fluidized product is introduced into the melt.

8 Claims, No Drawings

AGENT AND PROCESS FOR DESULFURIZING MOLTEN METALS

The present invention relates to an agent for desulfurizing molten materials, in particular molten iron, based on $CaC_2/CaO$ crystal blends obtained by smelting, and to processes for desulfurizing metal melts with the use of this agent.

U.S. Pat. No. 3,771,259 has disclosed a process for producing calcium carbide of low liter capacity from calcium carbide of higher liter capacity, wherein calcium oxide of a grain size from 1 to 8 mm is introduced into liquid calcium carbide of higher liter capacity, it being particularly advantageous to feed the calcium oxide during tapping into the jet of molten calcium carbide. As a result, the liter capacity of the molten calcium carbide is reduced from 280 to 300 1 of acetylene/kg of carbide to 230 to 260 1 of acetylene/kg of carbide.

The agent for desulfurizing molten crude iron or steel according to U.S. Pat. No. 4,323,392, which contains 20 to 55% by weight of $CaC_2$ and 45 to 80% by weight of CaO, is produced by introducing finely dispersed calcium oxide, preheated to temperatures of up to 2000° C., in a total quantity from 48 to 95% by weight, relative to the end product, into a calcium carbide melt obtained in the known manner and having a CaO content of up to 45% by weight.

Finally, the fine-grained agent for desulfurizing molten iron according to European Published Application 226,994 is composed essentially of technical calcium carbide (containing 65 to 85% by weight of $CaC_2$) and dried coal with at least 15% by weight of volatile constituents, wherein the coal content can be 2 to 50% by weight. Moreover, the fine-grained agent can additionally contain magnesium.

A disadvantage of the last-mentioned fine-grained agent is that it has a high $CaC_2$ content, which adversely affects the economics of the desulfurization of molten iron.

It is therefore the object of the present invention to provide an agent for desulfurizing molten metals, in particular molten iron, based on $CaC_2/CaO$ crystal blends obtained by smelting, by means of which an at least equally good desulfurization effect as with the finegrained agent known from European Published Application 226,994 is achieved at a lower $CaC_2$ content. According to the invention, this is achieved by an agent which comprises a $CaC_2/CaO$ crystal blend with a maximum of 62% by weight, in particular a maximum of 60% by weight, of $CaC_2$, gas-evolving substances and 0 t 44% by weight of metallic magnesium as the components.

Furthermore, the agent according to the invention can also be developed, if desired, in such a way that (a) the components present are 50 to 96% by weight of the $CaC_2/CaO$ crystal blend and 4 to 50% by weight of gas-evolving substances;

(b) at least 1.5% by weight, preferably 7 to 32% by weight, of the magnesium component is present;

(c) the $CaC_2/CaO$ crystal blend component contains at least 20% by weight of $CaC_2$;

(d) coals containing volatile constituents serve as the gas-evolving substances;

(e) the coals contain 20 to 60% by weight of volatile constituents.

In the process for desulfurizing molten metals, in particular molten iron, using the agent according to the invention, either both the mixture comprising the $CaC_2/CaO$ crystal blend and gas-evolving substances, and the magnesium, are fluidized separately and the two fluidized products are combined immediately before they enter the melt, or the three components, $CaC_2/CaO$ crystal blend, gas-evolving substances and magnesium, are fluidized together and the fluidized product is introduced into the melt. Dry air, nitrogen, rare gases or mixtures thereof can here be used for fluidization.

The agent according to the invention has grain sizes of at least 90% by weight of $<100$ μm, preferably 85% by weight of $<63$ μm.

0.01 to 0.7% by weight of flow improver can have been added to the agent according to the invention.

A substance evolving carbon dioxide, for example dolomite or calcium carbonate, can also have been added to the agent according to the invention.

When the agent according to the invention is used, a reduction in the desulfurization costs is achieved, since $CaC_2$ is replaced by CaO in this agent and the value of the two substances is in a ratio of about 8 : 1.

As shown by the examples, the desulfurization effect is improved, as compared with the state of the art, when the agent according to the invention is used.

The following examples are essentially compiled in Tables 1 and 2, the following abbreviations being used in the tables:

Carbide: technical calcium carbide (65 to 85% by weight of $CaC_2$)

$CaC_2/CaO$ a crystal blend of calcium carbide and calcium oxide, produced by smelting %: % by weight CI [t]: a quantity of crude iron in tonnes Agent [kg/t of CI]: kg of desulfurizing agent per tonne of crude iron Agent [kg/min]: kg of desulfurizing agent introduced per minute into the molten crude iron Gas [1(S.T.P)/kg]: carrier gas used for blowing the desulfurizing agent into the molten iron; rate of carrier gas applied per kg of desulfurizing agent $S_I$: sulfur content of the molten crude iron before the treatment with desulfurizing agent; in % by weight $S_E$: sulfur content of the moltencrude iron after the treatment with desulfurizing agent; in % by weight B [min]: duration of treatment in minutes K: characteristic value of the efficacy of the desulfurizing agent The following relationship applies between the quantity of crude iron in t of CI, the initial sulfur content $S_I$, the end sulfur content $S_E$ and the quantity of desulfurizing agent employed:

$$K = \frac{\text{kg of desulfurizing agent}}{t \text{ of } CI} \sigma \frac{1}{1 \text{ g} \frac{S_I}{S_E}}$$

(cf. H. M. Delhey: "Beitrag über die Entschwefelung von flüssigem Roheisen mit Kalk und Calciumcarbid nach dem Tauchlanzenverfahren [Contribution to the desulfurization of molten crude iron with lime and calcium carbide by the immersion lance process]", Doctorate Thesis, Clausthal Technical University, 1988).

Using this relationship, the quantity of desulfurizing agent to be employed per t of molten crude iron in the desulfurization of molten crude iron is calculated from the initial sulfur content in the desired end sulfur content:

$$\frac{\text{kg of desulfurizing agent}}{t \text{ of } CI} = K \sigma 1 g \frac{S_A}{S_E}$$

The relationship shows that the consumption of desulfurizing agent per t of molten crude iron for a desired $S_I/S_E$ ratio is the lower, the smaller the reaction constant K.

EXAMPLE 1

Tests A to F (cf. Table 1) were carried out in open ladles.

Desulfurizing agents known from European Published Application 226,994 were used here for tests A and C, whereas desulfurizing agents according to the invention were employed for tests B, D, E and F. Finally, in test E, the desulfurizing agent was introduced by co-injection of a mixture of $CaC_2/CaO$ and bright-burning coal on the one hand and magnesium on the other hand into the molten crude iron (cf. patent claims 7 and 9).

EXAMPLE 2

Tests G to K (cf. Table 2) were carried out in torpedo ladles.

Desulfurizing agents known from European Published Application 226,994 were used here for tests G and I, whereas desulfurizing agents according to the invention were employed for tests H, J and K.

We claim:

1. An agent for desulphurizing molten metals consisting essentially of the following components: a $CaC_2$-/CaO crystal blend containing 20 to 62% by weight $CaC_2$; coals containing 20 to 60% by weight of volatile constituents; and 1.5 to 44% by weight of metallic magnesium.

2. The agent as claimed in claim 1, wherein the $CaC_2$-/CaO crystal blend contains a maximum of b 60% by weight of $CaC_2$.

3. The agents as claimed in claim 1, containing 50 to 96% by weight of $CaC_2/CaO$ crystal blend.

4. The agent as claimed in claim 1, containing 7 to 32% by weight of magnesium.

5. A process for desulfurizing molten metals, using the agent as claimed in claim 1, which comprises fluidizing both the mixture, comprising the $CaC_2/CaO$ crystal blend and gas-evolving substances as the components, and the magnesium separately and combining the two fluidized products immediately before they enter the melt.

6. The process as claimed in claim 5, wherein dry air, nitrogen, rare gases or mixtures thereof are used for the fluidization.

7. A process for desulfurizing molten metals, using the agent as claimed in claim 1, which comprises fluidizing together the $CaC_2/CaO$ crystal coals and magnesium as the components and introducing the fluidized product into the melt.

8. The process as claimed in claim 7, wherein dry air, nitrogen, rare gases or mixtures thereof are used for the fluidization.

* * * * *

TABLE 1

| | Test Desulfurizing agents | CI[t] | Agent [kg/t of CI] | Agent [kg/min] | Gas [1(S.T.P.)/kg] | $S_I$ | $S_E$ | B [min] | K |
|---|---|---|---|---|---|---|---|---|---|
| A | 95% carbide ( 65% $CaC_2$)<br>5% lignite | 135 | 1.95 | 40 | Air<br>7.0 | 0.033 | 0.012 | 6.6 | 4.43 |
| B | 85% $CaC_2/CaO$ (54% $CaC_2$)<br>15% bright-burning coal | 300 | 2.83 | 70 | Air<br>6.8 | 0.037 | 0.008 | 12.1 | 4.25 |
| C | 82% carbide ( 65% $CaC_2$)<br>5% lignite<br>13% magnesium | 146 | 2.04 | 60 | $N_2$<br>6.5 | 0.034 | 0.008 | 5.0 | 3.24 |
| D | 82% $CaC_2/CaO$ (55% $CaC_2$)<br>8% bright-burning coal<br>10% magnesium | 300 | 1.83 | 70 | $N_2$<br>6.2 | 0.030 | 0.007 | 7.8 | 2.90 |
| E | 82% $CaC_2/CaO$ (52% $CaC_2$)<br>5% bright-burning coal<br>13% magnesium | 300 | 1.97 | 60 | $N_2$<br>6.6 | 0.042 | 0.009 | 9.9 | 2.94 |
| F | 85% $CaC_2/CaO$ (50% $CaC_2$)<br>5% bright-burning coal<br>10% magnesium | 300 | 2.11 | 70 | $N_2$<br>6.5 | 0.051 | 0.009 | 9.0 | 2.80 |

TABLE 2

| | Test Desulfurizing agents | CI[t] [kg/t of CI] | Agent [kg/min] | Agent [1(S.E.T.)/kg] | Gas | $S_I$ | $S_E$ [min] | B | K |
|---|---|---|---|---|---|---|---|---|---|
| G | 85% carbide ( 65% $CaC_2$)<br>15% bright-burning coal | 159 | 3.20 | 45 | $N_2$<br>12.5 | 0.048 | 0.012 | 11.3 | 5.31 |
| H | 85% $CaC_2/CaO$ (54% $CaC_2$)<br>15% bright-burning coal | 175 | 2.79 | 60 | $N_2$<br>10.5 | 0.050 | 0.011 | 8.1 | 4.25 |
| I | 75% carbide ( 65% $CaC_2$)<br>15% bright-burning coal<br>10% magnesium | 180 | 2.15 | 55 | $N_2$<br>15 | 0.045 | 0.010 | 7.0 | 3.29 |
| J | 75% $CaC_2/CaO$ (55% $CaC_2$)<br>12% bright-burning coal<br>13% magnesium | 180 | 2.29 | 63 | $N_2$<br>10 | 0.043 | 0.007 | 6.5 | 2.90 |
| K | 80% $CaC_2/CaO$ (52% $CaC_2$)<br>10% bright-burning coal<br>10% magnesium | 170 | 2.30 | 65 | $N_2$<br>9.5 | 0.051 | 0.009 | 6.0 | 3.05 |